US009796188B2

(12) United States Patent
Arakane et al.

(10) Patent No.: US 9,796,188 B2
(45) Date of Patent: Oct. 24, 2017

(54) LIQUID DISCHARGING DEVICE

(71) Applicant: BROTHER KOGYO KABUSHIKI KAISHA, Nagoya, Aichi (JP)

(72) Inventors: Satoru Arakane, Aichi (JP); Kenji Kawamoto, Aichi (JP); Tsuyoshi Kuwayama, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/281,895

(22) Filed: Sep. 30, 2016

(65) Prior Publication Data

US 2017/0087906 A1 Mar. 30, 2017

(30) Foreign Application Priority Data

Sep. 30, 2015 (JP) ..... 2015-195358

(51) Int. Cl.

*B41J 29/393* (2006.01)
*B41J 2/21* (2006.01)
*B41J 2/045* (2006.01)
*B41J 25/308* (2006.01)

(52) U.S. Cl.

CPC ..... *B41J 2/2135* (2013.01); *B41J 2/04505* (2013.01); *B41J 2/04573* (2013.01); *B41J 25/308* (2013.01)

(58) Field of Classification Search

CPC .... B41J 2/2135; B41J 2/04573; B41J 25/308; B41J 2/04505

See application file for complete search history.

(56) References Cited

U.S. PATENT DOCUMENTS

2011/0001778 A1* 1/2011 Kanda ..... B41J 11/0025 347/37
2013/0135628 A1* 5/2013 Kuno ..... H04N 1/6041 358/1.2
2013/0257938 A1* 10/2013 Arakane ..... B41J 25/3082 347/8
2013/0257940 A1* 10/2013 Terada ..... B41J 25/001 347/8
2013/0257948 A1* 10/2013 Terada ..... B41J 2/07 347/14

(Continued)

FOREIGN PATENT DOCUMENTS

JP 3557915 B2 8/2004
JP 2013-212586 A 10/2013

*Primary Examiner* — Julian Huffman
(74) *Attorney, Agent, or Firm* — Scully, Scott, Murphy & Presser, PC

(57) ABSTRACT

A liquid discharging device including a liquid discharging head with nozzles, a carriage, and a controller is provided. When a position of the end of a sheet is on an inner side of an outmost contact part among a plurality of contact parts along a scanning direction, the controller determines discharging timings to discharge liquid from the nozzles based on first gap information, which is related to a gap between the sheet and the liquid discharging surface and is stored in a gap information storage. When the position of the end of the sheet is on the inner side of the outmost contact part, the controller determines the discharging timings based on the first gap information stored in the gap information storage and on second gap information generated in a gap information generating process.

16 Claims, 11 Drawing Sheets

(56) References Cited

U.S. PATENT DOCUMENTS

| | | | | |
|---|---|---|---|---|
| 2013/0271518 | A1* | 10/2013 | Morita | B41J 2/07 347/8 |
| 2014/0168300 | A1* | 6/2014 | Kubo | B41J 2/2135 347/11 |
| 2015/0029254 | A1* | 1/2015 | Arakane | B41J 2/2135 347/16 |
| 2015/0029263 | A1* | 1/2015 | Arakane | B41J 2/04503 347/37 |
| 2015/0202903 | A1* | 7/2015 | Arakane | B41J 2/2135 347/14 |
| 2015/0273823 | A1* | 10/2015 | Kato | B41J 2/04573 347/9 |
| 2015/0343766 | A1* | 12/2015 | Noda | B41J 2/04573 347/14 |

* cited by examiner

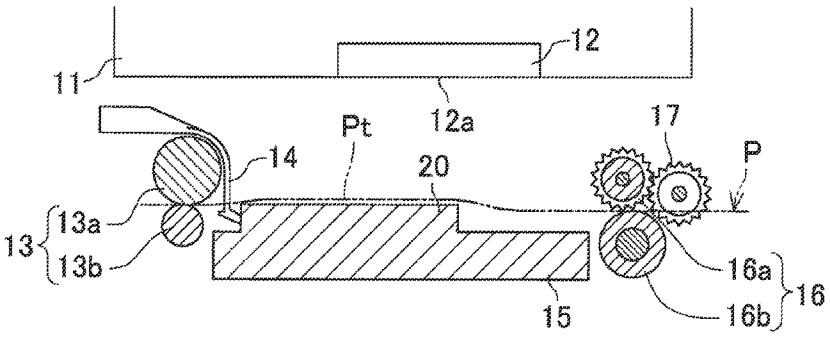
FIG. 4A
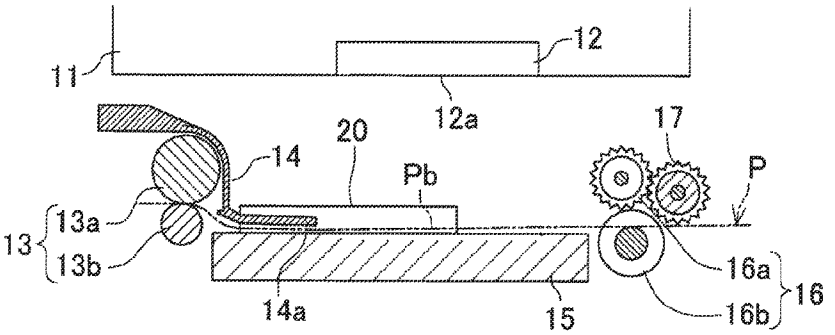
FIG. 4B
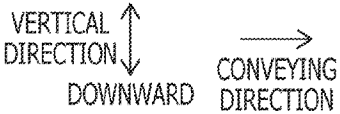

| POSITION | $F_1$ | $F_2$ | $F_3$ | ··· | $F_{15}$ | $F_{16}$ | $F_{17}$ |
|---|---|---|---|---|---|---|---|
| FIRST DELAY AMOUNT | $D_1$ | $D_2$ | $D_3$ | ··· | $D_{15}$ | $D_{16}$ | $D_{17}$ |

FIG. 7A

| SHEET SIZE | POSITION OF LEFTWARD END | POSITION OF RIGHTWARD END |
|---|---|---|
| A4 | $E_{L1}(=F_1)$ | $E_{R1}(=F_{17})$ |
| A3 | $E_{L1}(=F_1)$ | $E_{R1}(=F_{17})$ |
| Exective | $E_{L2}(=F_3)$ | $E_{R2}(=F_{15})$ |
| B5 | $E_{L3}$ | $E_{R3}$ |
| Letter | $E_{L4}$ | $E_{R4}$ |
| ⋮ | ⋮ | ⋮ |

FIG. 7B

LIQUID DISCHARGING DEVICE

CROSS REFERENCE TO RELATED APPLICATION

This application claims priority under 35 U.S.C. §119 from Japanese Patent Application No. 2015-195358, filed on Sep. 30, 2015, the entire subject matter of which is incorporated herein by reference.

BACKGROUND

Technical Field

The following description relates to one or more aspects of a liquid discharging device capable of discharging liquid through nozzles.

Related Art

A liquid discharging device, e.g., a printer, configured to discharge liquid through nozzles at a recording sheet to print an image, is known. The printer may include a plurality of corrugating plates arranged in line along a scanning direction to face an upper surface of a platen. Meanwhile, a plurality of ribs may be arranged in line in areas on the upper surface of the platen to protrude at intermediate positions between adjoining corrugating plates. Thus, the recording sheet may be pressed downward by the plurality of corrugating plates above and upward by the plurality of ribs below so that the recording sheet may be deformed into a corrugated shape that ripples up and down along the scanning direction.

Meanwhile, in order to determine discharging timings to discharge liquid, e.g., ink, at the recording sheet, which is deformed into the corrugated shape in the printer, a patch of image may be printed on the recording sheet, and the printed image may be read by a scanner. Based on the read image, deviation amounts of the ink at peaks of convex portions that protrude upward and bottoms of concave portions that recess downward in the recording sheet from intended positions on a hypothetical plane may be achieved and stored in advance in a memory. The stored deviation amounts may be used to determine the discharging timings to discharge the ink through the nozzles.

SUMMARY

Thus, in the known printer, the deviation amounts may be achieved from the read image, which is printed on the recording sheet while the recording sheet is set to contact every one of the corrugating plates and the ribs in the printer. Meanwhile, the printer may print an image on a recording sheet, of which dimension in the scanning direction is smaller than that of the recording sheet used for printing the patch of image. Such a recording sheet with the smaller dimension may not contact every one of the corrugating plates or the ribs when set on the platen. Thus, a corrugated shape of the recording sheet may not always be identical with the recording sheet used for the patch of image. Therefore, if the discharging timings are determined based on the deviation amounts that are designed for the recording sheet in a specific size and stored in advance, the discharging timings may not be optimal for the recording sheet in a different size, such as the recording sheet having the shorter dimension.

Aspects of the present disclosure are advantageous in that a liquid discharging device capable of discharging liquid at a corrugated sheet at preferable discharging timings is provided.

According to an aspect of the present disclosure, a liquid discharging device including a liquid discharging head, a carriage, a sheet conveyer, a plurality of contact parts, a gap information storage, and a controller, is provided. The liquid discharging head includes a plurality of nozzles and a liquid discharging surface, and the plurality of nozzles are arranged on the liquid discharging surface. The carriage, on which the liquid discharging head is mounted, is configured to move in a scanning direction, which is parallel with the liquid discharging surface of the liquid discharging head. The sheet conveyer is configured to convey a sheet in a conveying direction, which is parallel with the liquid discharging surface and intersecting with the scanning direction. The plurality of contact parts are arranged to be spaced apart from one another along the scanning direction. The plurality of contact parts are configured to contact the sheet along a direction orthogonal to the liquid discharging surface, while the sheet is conveyed to face the liquid discharging surface. The gap information storage is configured to store first gap information, which is related to a gap between the sheet and the liquid discharging surface. The controller is configured to control the liquid discharging head and the carriage. The controller is configured to execute an end position obtaining process, in which the controller obtains a position of an end of the sheet in the scanning direction; a position determining process, in which the controller determines whether the position of the end of the sheet obtained in the end position obtaining process is located on an inner side of an outmost contact part among the plurality of contact parts along the scanning direction; a gap information generating process, in which the controller generates second gap information under a condition where the position of the end of the sheet obtained in the end position obtaining process is determined to be located on the inner side of the outmost contact part among the plurality of contact parts along the scanning direction, the second gap information being related to a gap between the sheet and the liquid discharging surface at a position on an outer side of one of the plurality of contact parts that contacts the end of the sheet; a discharging-timing determining process, in which the controller determines discharging timings to discharge the liquid from the plurality of nozzles; and a liquid discharging process, in which the controller manipulates the carriage to move in the scanning direction and the liquid discharging head to discharge the liquid from the plurality of nozzles at the discharging timings determined in the discharging-timing determining process. Under a condition where the position of the end of the sheet obtained in the end position obtaining process is determined not to be located on the inner side of the outmost contact part among the plurality of contact parts along the scanning direction in the position determining process, in the discharging-timing determining process, the controller determines the discharging timings to discharge the liquid from the plurality of nozzles based on the first gap information stored in the gap information storage. Under the condition where the position of the end of the sheet obtained in the end position obtaining process is determined to be located on the inner side of the outmost contact part among the plurality of contact parts along the scanning direction in the position determining process, in the discharging-timing determining process, the controller determines the discharging timings to discharge the liquid from the plurality of nozzles based on the first gap information stored in the gap information storage and on the second gap information generated in the gap information generating process.

According to another aspect of the present disclosure, a liquid discharging device including a liquid discharging head, a sheet conveyer, a plurality of contact parts, a gap information storage, and a controller, is provided. The liquid discharging head includes a plurality of nozzles and a liquid discharging surface. The plurality of nozzles are arranged on the liquid discharging surface. The sheet conveyer is configured to convey a sheet in a conveying direction, which is parallel with the liquid discharging surface. The plurality of contact parts are arranged to be spaced apart from one another along a width direction, which is parallel with the liquid discharging surface and intersecting with the conveying direction. The plurality of contact parts are configured to contact the sheet along a direction orthogonal to the liquid discharging surface. The sheet is conveyed to face the liquid discharging surface. The gap information storage is configured to store first gap information, which is related to gaps between the sheet and the liquid discharging surface at a plurality of positions spaced apart from one another along the width direction. The controller is configured to control the liquid discharging head. The controller is configured to execute: an end position obtaining process, in which the controller obtains a position of an end of the sheet in the width direction; a position determining process, in which the controller determines whether the position of the end of the sheet obtained in the end position obtaining process is located on an inner side of an outmost contact part among the plurality of contact parts along the width direction; a gap information generating process, in which the controller generates second gap information under a condition where the position of the end of the sheet obtained in the end position obtaining process is determined to be located on the inner side of the outmost contact part among the plurality of contact parts along the width direction, the second gap information being related to a gap between the sheet and the liquid discharging surface at a position on an outer side of one of the plurality of contact parts that contacts the end of the sheet; a discharging-timing determining process, in which the controller determines discharging timings to discharge the liquid from the plurality of nozzles; and a liquid discharging process, in which the controller manipulates the liquid discharging head to discharge the liquid from the plurality of nozzles at the discharging timings determined in the discharging-timing determining process. Under a condition where the position of the end of the sheet obtained in the end position obtaining process is determined not to be located on the inner side of the outmost contact part among the plurality of contact parts along the width direction in the position determining process, in the discharging-timing determining process, the controller determines the discharging timings to discharge the liquid from the plurality of nozzles based on the first gap information stored in the gap information storage. Under the condition where the position of the end of the sheet obtained in the end position obtaining process is determined to be located on the inner side of the outmost contact part among the plurality of contact parts along the width direction in the position determining process, in the discharging-timing determining process, the controller determines the discharging timings to discharge the liquid from the plurality of nozzles based on inner-side first gap information among the first gap information stored in the gap information storage and on the second gap information generated in the gap information generating process, the inner-side first gap information being related to the gaps between the sheet and the liquid discharging surface at positions on an inner side with respect to the end of the sheet in the width direction.

BRIEF DESCRIPTION OF THE ACCOMPANYING DRAWINGS

FIG. 4A is a cross-sectional view taken along a line IVA-IVA shown in FIG. 2 according to the embodiment of the present disclosure. FIG. 4B is a cross-sectional view taken along a line IVB-IVB shown in FIG. 2 according to the embodiment of the present disclosure.

FIG. 7A is a table, in which positions of corrugating plates and ribs are associated with first delay amounts, stored in an electrically erasable programmable read-only memory (EEPROM) in the inkjet printer according to the embodiment of the present disclosure. FIG. 7B is a table, in which sizes of recording sheets are associated with positions of leftward and rightward ends of the recording sheets, stored in the EEPROM in the inkjet printer according to the embodiment of the present disclosure.

Figure 2:
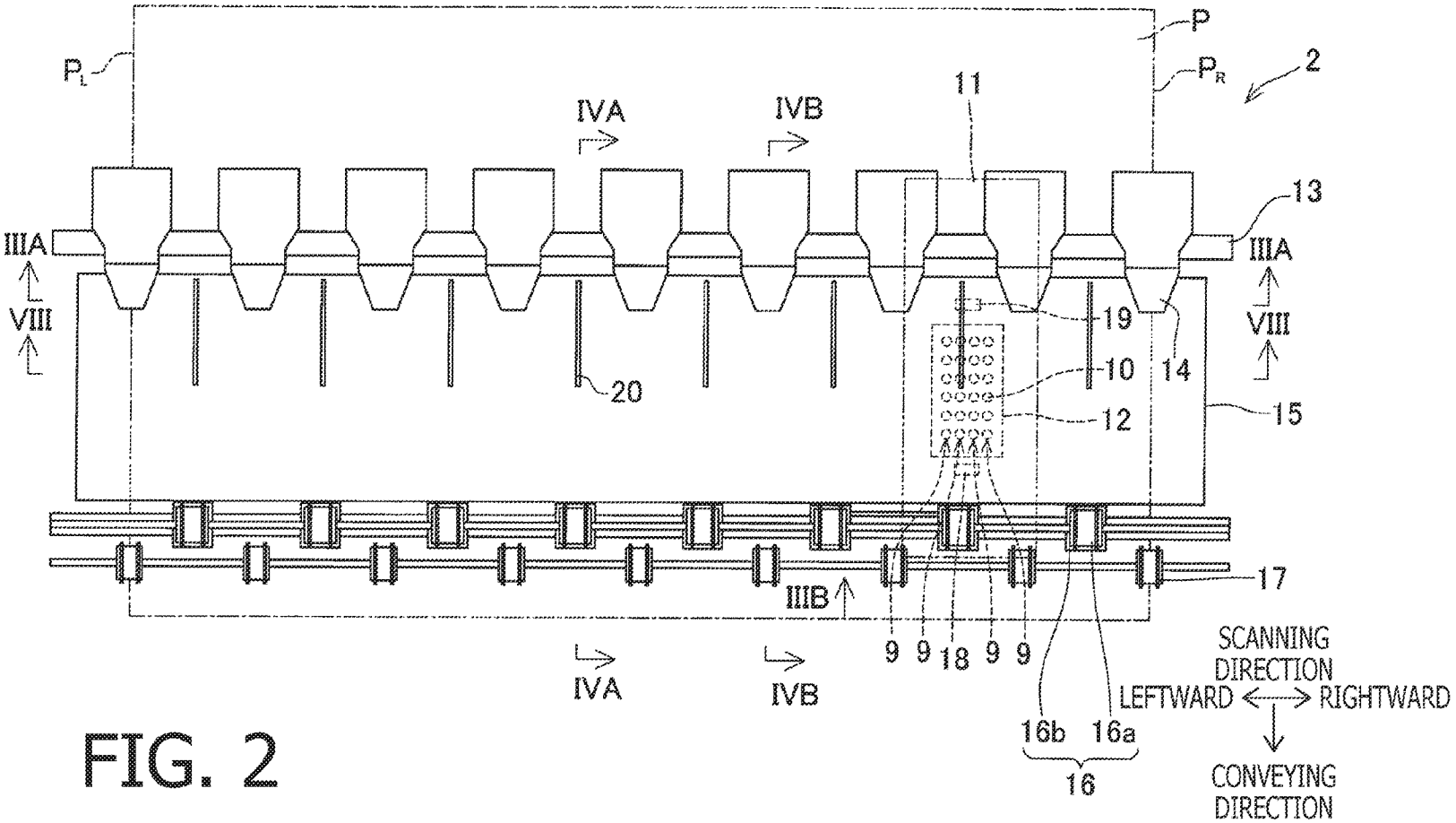
FIG. 2 is a plan view of a printer unit in the inkjet printer according to the embodiment of the present disclosure.
Figure 8A:
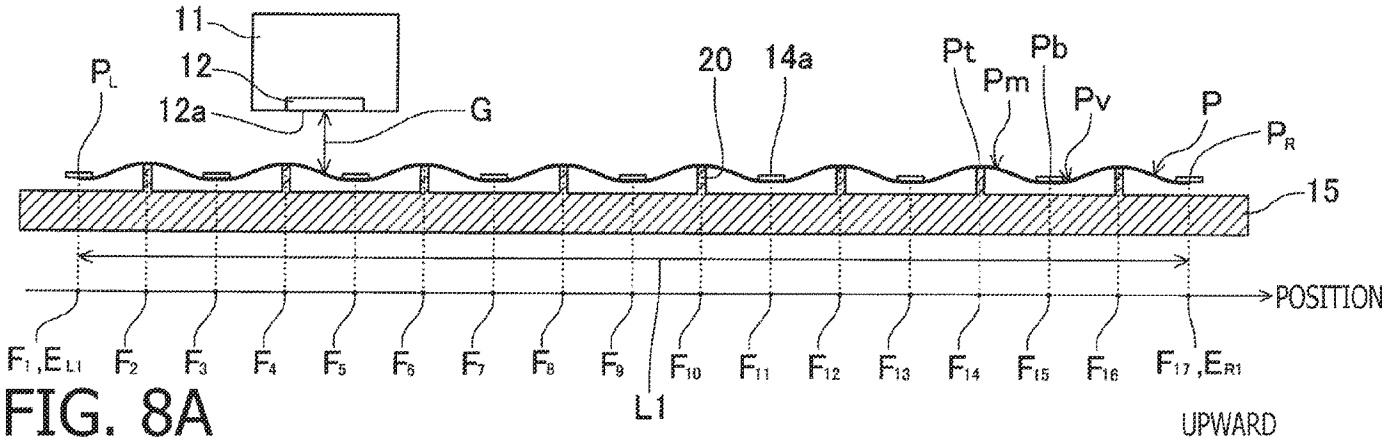
Figure 8B:
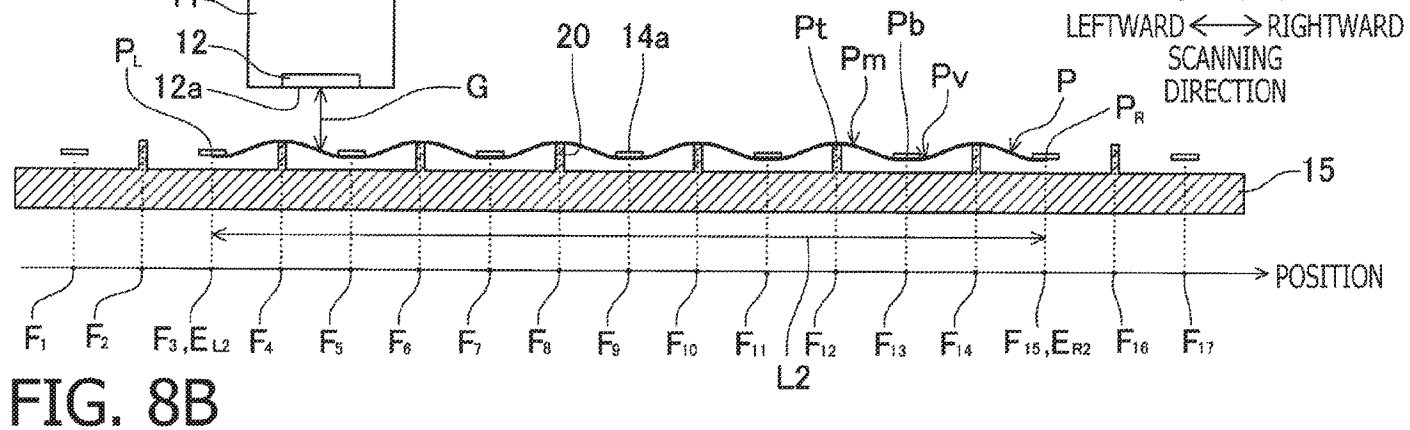

FIG. 8A illustrates a height of an A4- or A3-sized recording sheet at each position along the scanning direction, when viewed along a line VIII-VIII shown in FIG. 2, according to the embodiment of the present disclosure. FIG. 8B illustrates a height of an executive-sized recording sheet at each position along the scanning direction, when viewed along the line VIII-VIII shown in FIG. 2, according to the embodiment of the present disclosure.

Figure 9A:
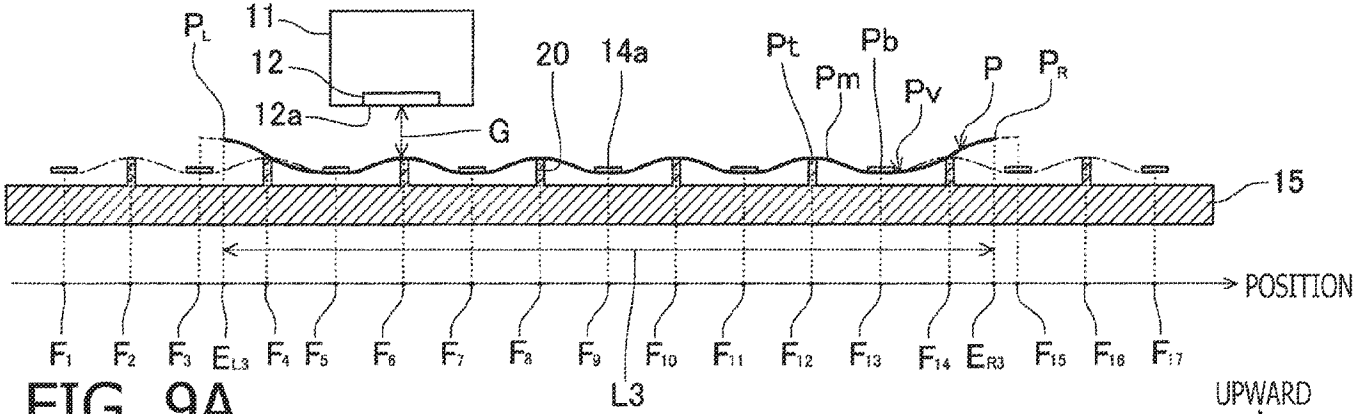
Figure 9B:
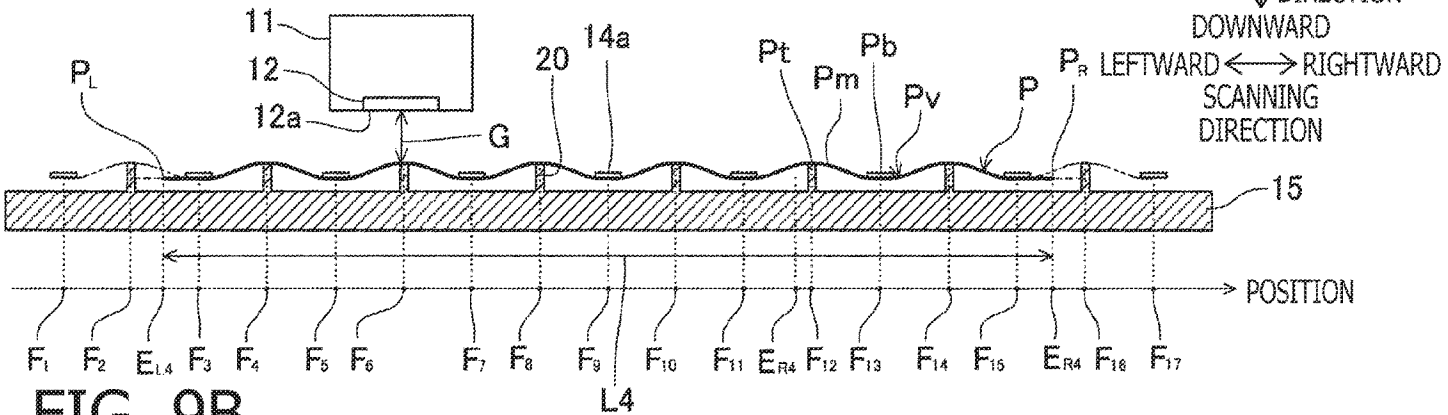

FIG. 9A illustrates a height of a B5-sized recording sheet at each position along the scanning direction, when viewed along the line VIII-VIII shown in FIG. 2, according to the embodiment of the present disclosure. FIG. 9B illustrates a height of a letter-sized recording sheet at each position along the scanning direction, when viewed along the line VIII-VIII shown in FIG. 2, according to the embodiment of the present disclosure.

Figure 10:
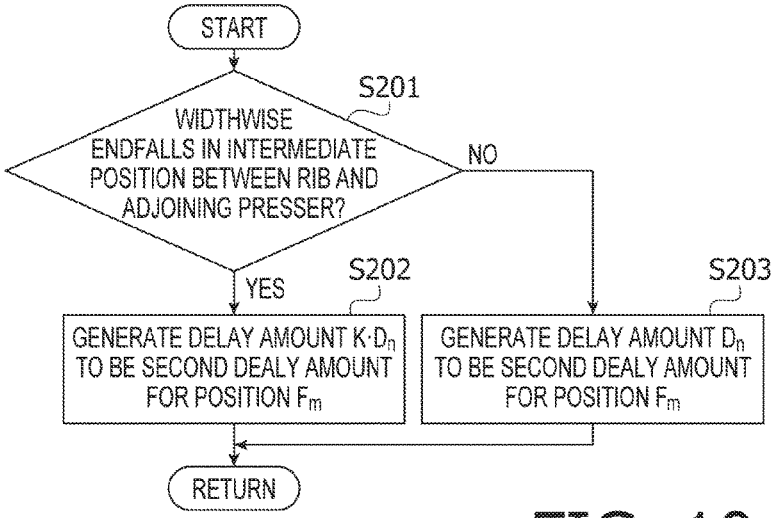

FIG. 10 is a flowchart to illustrate a flow of steps in a second delay amount determining process to be conducted by the controller in the inkjet printer according to the embodiment of the present disclosure.

Figure 11A:
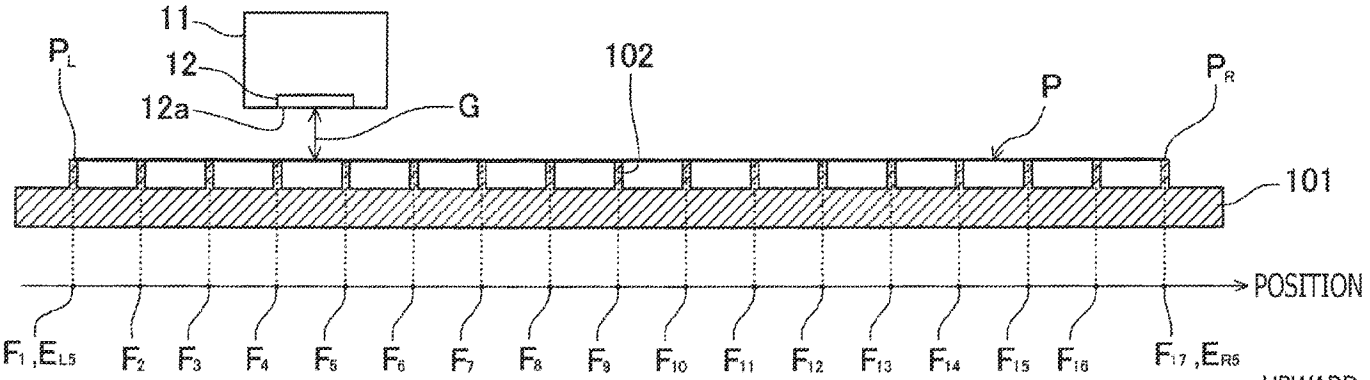
Figure 11B:
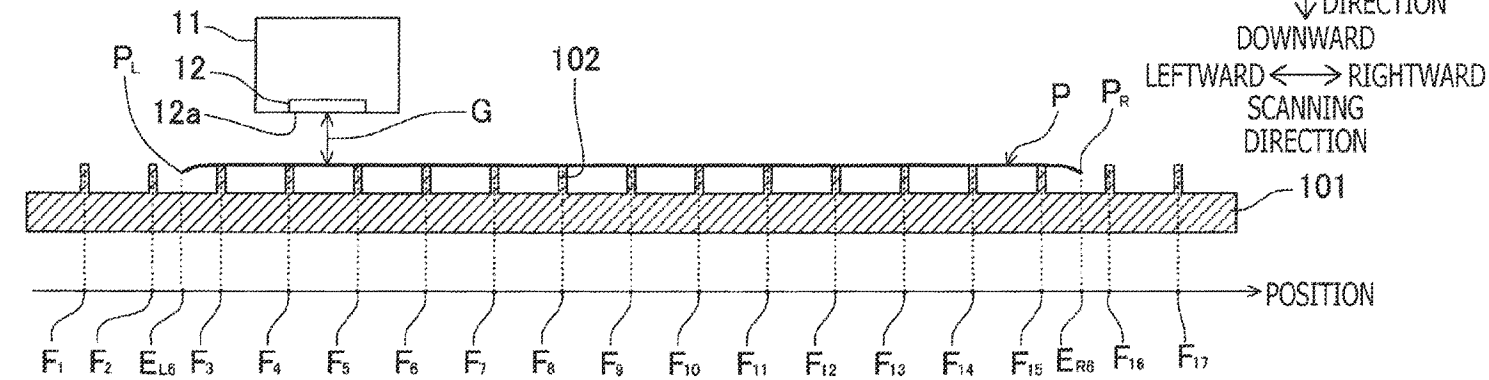

FIG. 11A is a modified example to illustrate a height of a recording sheet at each position along the scanning direction, when widthwise ends of the recording sheet are in positions of outmost ribs in the inkjet printer, according to the embodiment of the present disclosure. FIG. 11B is another modified example to illustrate a height of a recording sheet at each position along the scanning direction, when widthwise ends of the recording sheet are in positions between two adjoining ribs in the inkjet printer, according to the embodiment of the present disclosure.

DETAILED DESCRIPTION

Hereinafter, an embodiment according to an aspect of the present disclosure will be described in detail with reference to the accompanying drawings.

It is noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an EEPROM, a CD-media, DVD-media, temporary storage, hard disk drives, floppy drives, permanent storage, and the like.

An inkjet printer 1 of the embodiment may be a multi-function peripheral (MFP) having a plurality of functions such as a printing function to perform printing on a recording sheet P and an image reading function to read an image on a sheet. The inkjet printer 1 includes a printer unit 2 (see FIG. 2), a sheet feeder unit 3, a sheet ejector unit 4, a reader unit 5, an operation unit 6, and a display unit 7. Further, the inkjet printer 1 includes a controller 50 configured to control operations of the inkjet printer 1 (see FIG. 5).

The printer unit 2 is provided inside the inkjet printer 1. The printer unit 2 is configured to perform printing on the recording sheet P. A detailed configuration of the printer unit 2 will be described later. The sheet feeder unit 3 is configured to feed the recording sheet P to the printer unit 2. The sheet ejector unit 4 is configured to eject the recording sheet P, on which an image is printed by the printer unit 2, outside. The reader unit 5 may be an image scanner and may be configured to read images formed on original sheets. The operation unit 6 may include buttons. A user may operate the inkjet printer 1 via the buttons in the operation unit 6 to enter information or instructions. The display unit 7 may be a liquid crystal display, which may display information when the inkjet printer 1 is being used.

Figure 3A:
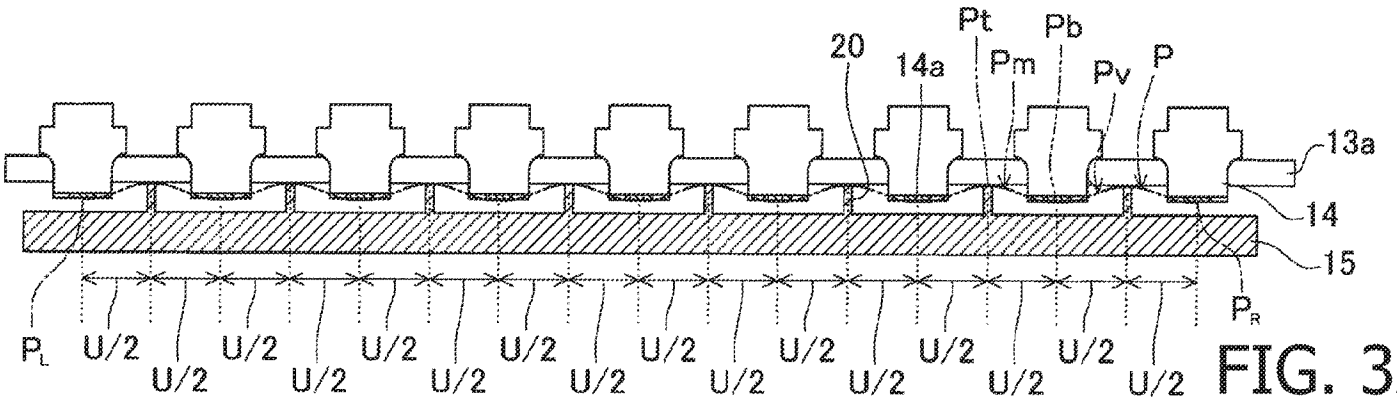
FIG. 3A illustrates a part of the printer unit viewed along an arrow IIIA shown in FIG. 2 according to the embodiment of the present disclosure.
Figure 3B:
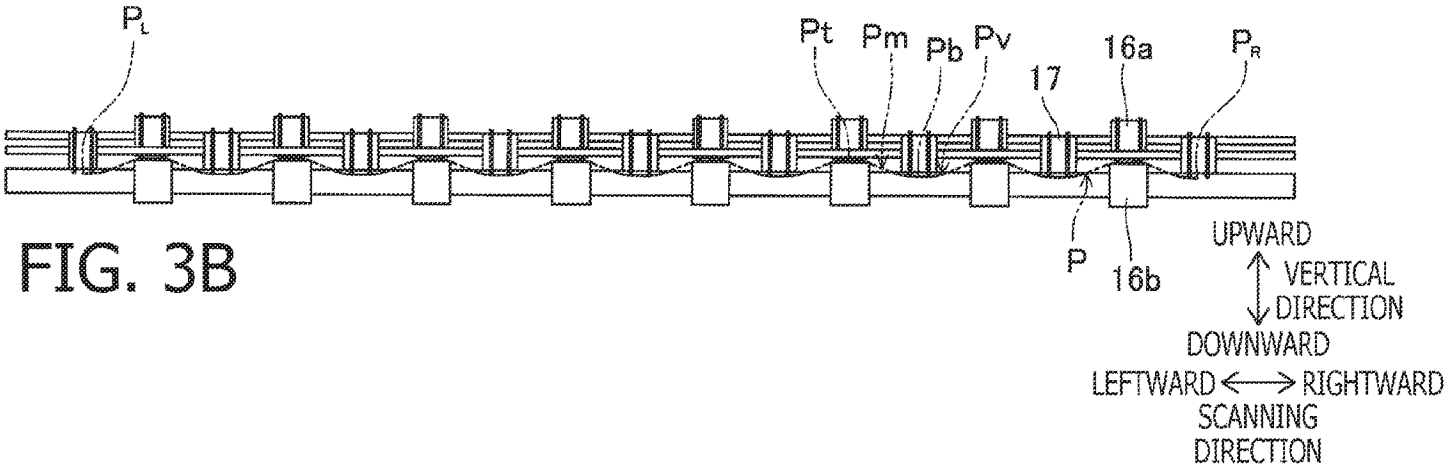
FIG. 3B illustrates a part of the printer unit viewed along an arrow IIIB shown in FIG. 2 according to the embodiment of the present disclosure.

Subsequently, the printer unit 2 will be described. As shown in FIGS. 2 to 4, the printer unit 2 includes a carriage 11, an inkjet head 12, a conveyer roller 13, a platen 15, a plurality of corrugating plates 14, ejection rollers 16, corrugating spur wheels 17, an encoder 18, and a medium sensor 19. It is noted that, for the sake of easy visual understanding in FIG. 2, the carriage 11 in an illustrative position is indicated by a dash-and-two-dots line, and items disposed below the carriage 11 are indicated by solid lines. Further, in FIG. 2, illustration of some of structures that support the carriage 11, e.g., a guiderail, may be omitted.

Figure 1:
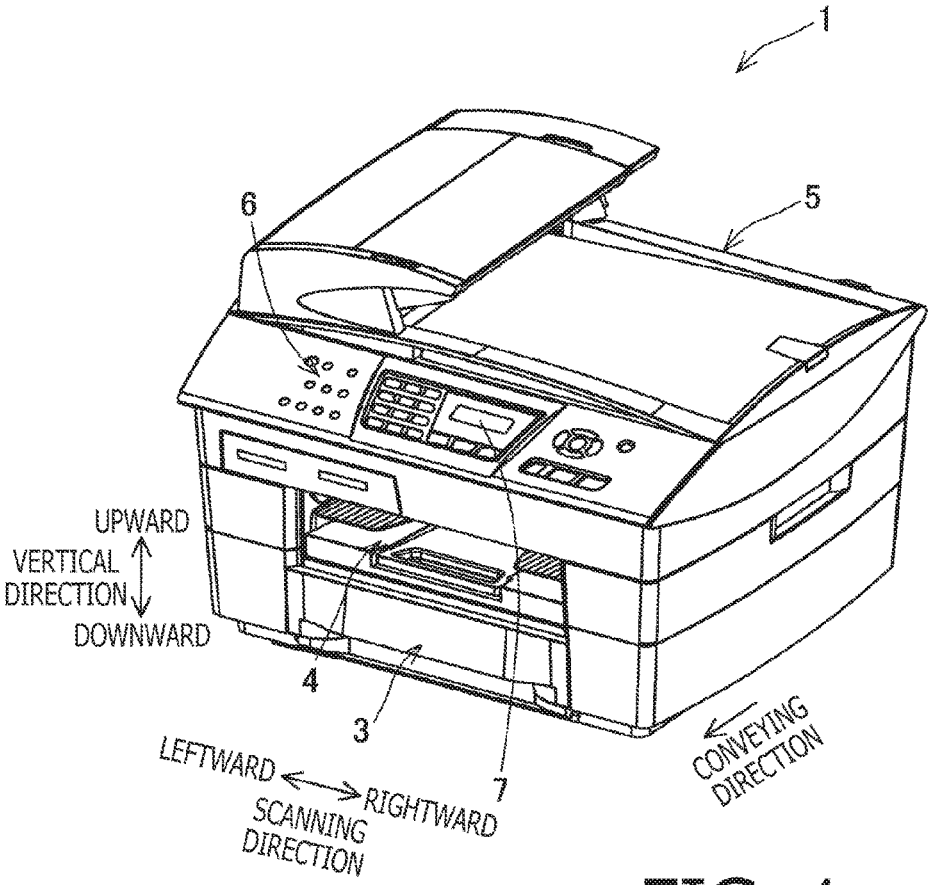
FIG. 1 is a perspective view schematically showing a configuration of an inkjet printer according to an exemplary embodiment of the present invention.

The carriage 11 is configured to reciprocate on the guiderail (not shown) along a predetermined scanning direction. In the present embodiment, the scanning direction may include a leftward (right-to-left) direction and a rightward (left-to-right) direction (see FIGS. 1 and 2, for example) and may be referred to as a widthwise direction. The carriage 11 is connected with carriage motor 56 (see FIG. 5) through a belt (not shown) to be driven by the carriage motor 56 and reciprocate in the scanning direction. In the following description, one end on the left and the other end on the right along the scanning direction will be defined as a leftward end and a rightward end, respectively.

The inkjet head 12 is mounted on the carriage 11 to be moved along with the carriage 11. The inkjet head 12 is configured to discharge ink from a plurality of nozzles 10 formed in an ink discharging surface 12*a*, which is a lower surface of the inkjet head 12. The nozzles 10 are formed in line that extends orthogonally to the scanning direction to form a nozzle row 9. Further, in the inkjet head 12, a plurality of, e.g., four (4), nozzle rows 9 are formed so that inks in four colors, e.g., black, yellow, cyan, and magenta, may be discharged separately from each nozzle row 9. For example, the nozzles 10 in the rightmost nozzle row 9 may discharge black ink, and the nozzles 10 in the nozzle rows 9 from the second, third, and fourth to the right may discharge yellow, cyan, and magenta inks, respectively.

The conveyer roller 13 is arranged in a position upstream from the inkjet head 12 with regard to a predetermined conveying direction, which may intersect orthogonally with the scanning direction, to convey the recording sheet P. The conveyer roller 13 includes an upper roller 13*a* and a lower roller 13*b*, which are configured to nip therebetween the recording sheet P fed by the sheet feeder unit 3 and convey the recording sheet P in the conveying direction. The upper roller 13*a* may be driven to rotate by a conveyer motor 57 (see FIG. 5), and the lower roller 13*b* may be rotated along with rotation of the upper roller 13*a*.

The plurality of corrugating plates 14 are disposed to extend from a position coincident with the conveyer roller 13 to a position downstream of the conveyer roller 13 with regard to the conveying direction. The corrugating plates 14 are arranged to be spaced apart evenly from one another at an interval U along the scanning direction. Each of the corrugating plates 14 includes a presser 14*a*, which may press the recording sheet P downward, at a downstream end thereof with regard to the conveying direction.

The platen 15 is arranged in a position downstream of the conveyer roller 13 with regard to the conveying direction to face the ink discharging surface 12*a* of the inkjet head 12. The platen 16 is arranged to longitudinally extend in the scanning direction to cover an entire movable range of the carriage 11 that is moved to reciprocate during a printing operation. On an upper surface of the platen 15, formed are a plurality of ribs 20, which extend in the conveying direction. The ribs 20 are arranged to be spaced apart evenly from one another at the interval U along the scanning direction in positions between adjoining corrugating plates 14. In other words, the corrugating plates 14 and the ribs 20 are arranged alternately along the scanning direction at an interval U/2.

The ejection rollers 16 are arranged in positions downstream of the inkjet head 12 with regard to the conveying direction. The ejection rollers 16 are located in the same positions as the ribs 16 with regard to the scanning direction. Each ejection roller 16 includes an upper roller 16*a* and a lower roller 16*b*, between which the recording sheet P may be nipped from above and below to be conveyed in the conveying direction. The ejection rollers 16 thus convey the recording sheet P in the conveying direction toward the sheet ejector unit 4. The lower rollers 16*b* may be driven to rotate by the conveyer motor 57 (see FIG. 5). The upper rollers 16*a* are spur wheels and may be rotated by the rotation of the lower rollers 16*b*. The upper rollers 16*a* may contact a printed surface of the recording sheet P, which is a surface having an image printed thereon in the printing operation. However, while the upper rollers 16*a* are spurs, of which outer circumferences are not smooth, the ink in the printed image on the recording sheet P may be restrained from being transferred to the upper rollers 16*a*. Thus, the conveyer roller 13 and the ejection rollers 16 may convey the recording sheet P.

The plurality of corrugating spur wheels 17 are arranged in positions downstream of the ejection rollers 16 in the conveying direction. The corrugating spur wheels 17 are substantially in the same positions as the pressers 14*a* of corrugating plates 14 with regard to the scanning direction. Meanwhile, the corrugating spur wheels 17 are placed at a level lower than a position where the ejection rollers 16 nip the recording sheet P therebetween, with regard to a vertical direction. Thereby, the corrugating spur wheels 17 may press the recording sheet P downward from above at the level lower than the position where the ejection rollers 16 nip the recording sheet P. Meanwhile, however, lower ends of the corrugating spur wheels 17 are at a level higher than the pressers 14*a* of the corrugating plates 14. Therefore, the corrugating spur wheels 17 may provide less intensive force to press the recording sheet P than the corrugating plates 14, and the ink in the image on the recording sheet P may be restrained from being transferred to the corrugating spur wheels 17. Further, the corrugating spur wheels 17 are not rollers with smooth outer circumferences but spur wheels. Therefore, the ink on the recording sheet P may be restrained from being transferred to the plurality of corrugating spur wheels 17.

Thus, the recording sheet P may be supported on the platen 15 by the contact of the ribs 20 on a lower surface from below and by the contact of the pressers 14*a* of the corrugating plates 14 and the corrugating spur wheels 17 on the upper surface from above to be deformed into the corrugating shave, as shown in FIGS. 3 and 4, in which mountain portions Pm protruding upward (i.e., toward the ink discharging surface 12*a*) and valley portions Pv recessed downward (i.e., in a direction opposite to the direction toward the ink discharging surface 12*a*) are alternately arranged along the scanning direction. Further, each mountain portion Pm has a top portion Pt, protruding up to a highest position of the mountain portion Pm, which is located substantially in the same position as a center of the corresponding one of the ribs 16 in the scanning direction. Each valley portion Pv has a bottom portion Pb, recessed downward to a lowest position of the valley portion Pv, which is located substantially in the same position as the corresponding one of the pressers 14*a*.

The encoder 18 is mounted on the carriage 11 and is configured to output signals indicating positions of the carriage 11, or the inkjet head 12, in the scanning direction to the controller 50. The medium sensor 19 is mounted on the carriage 11 in a position upstream of the inkjet head 3 in the conveying direction. The medium sensor 19 includes an emitter 19*a* and a receiver 19*b* (see FIG. 5). The emitter 19*a* may emit light at the platen 15, and the receiver 19*b* may receive reflection of the light. The surface of the platen 15 may be in a dark color, e.g., black, and when no recording sheet P is on the platen 15, the light from the emitter 19*a* may not be reflected on the platen 15 or received by the receiver 19*b*. Meanwhile, the recording sheet P may be in a lighter color, e.g., white, and when the recording sheet P is on the platen 15, the light from the emitter 19*a* may be reflected on the recording sheet P and received by the receiver 19*b*. Thus, the medium sensor 19 outputs the signals indicating presence of the recording sheet P on the platen 15 when the receiver 19*b* receives the reflected light. Therefore, based on the signals from the medium sensor 19, a leading end of the recording sheet P being conveyed may be detected.

Next, explanation concerning the controller 50 for controlling operations in the inkjet printer 1 will be provided below. The controller 50 includes a central processing unit (CPU) 51, a read only memory (ROM) 52, a random access memory (RAM) 53, an EEPROM 54, and an application specific integrated circuit (ASIC) 55.

The controller 50 controls behaviors of the carriage motor 56, the inkjet head 12, the conveyer motor 57, the reader unit 5, the display unit 7, the encoder 18, and the medium sensor 19. Further, the controller 50 may receive various types of signals, including signals corresponding to operations to the operation unit 6, and other signals output from the encoder 18 and the medium sensor 19.

Figure 5:
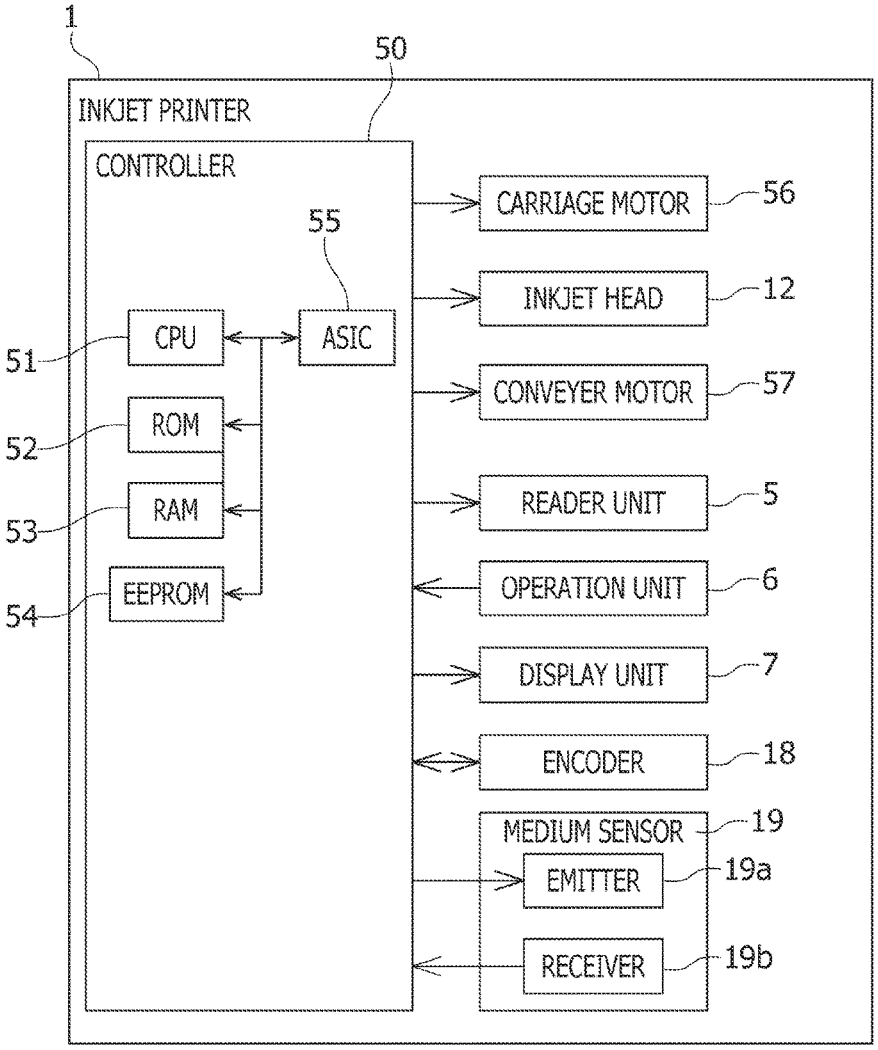
FIG. 5 is a block diagram to illustrate an electrical configuration of the inkjet printer according to the embodiment of the present disclosure.

While FIG. 5 shows solely one (1) CPU 51 to process the signals in the controller 50, the CPU 51 may not necessarily be limited to a single CPU 51 that processes the signals alone but may include a plurality of CPUs 51 that may share the loads of the signal-processing. Further, the ASIC 55 in the controller 50 may not necessarily be limited to a single ASIC that processes the signals alone but may include multiple ASICs 55 that may share the loads of the signal-processing.

Figure 6:
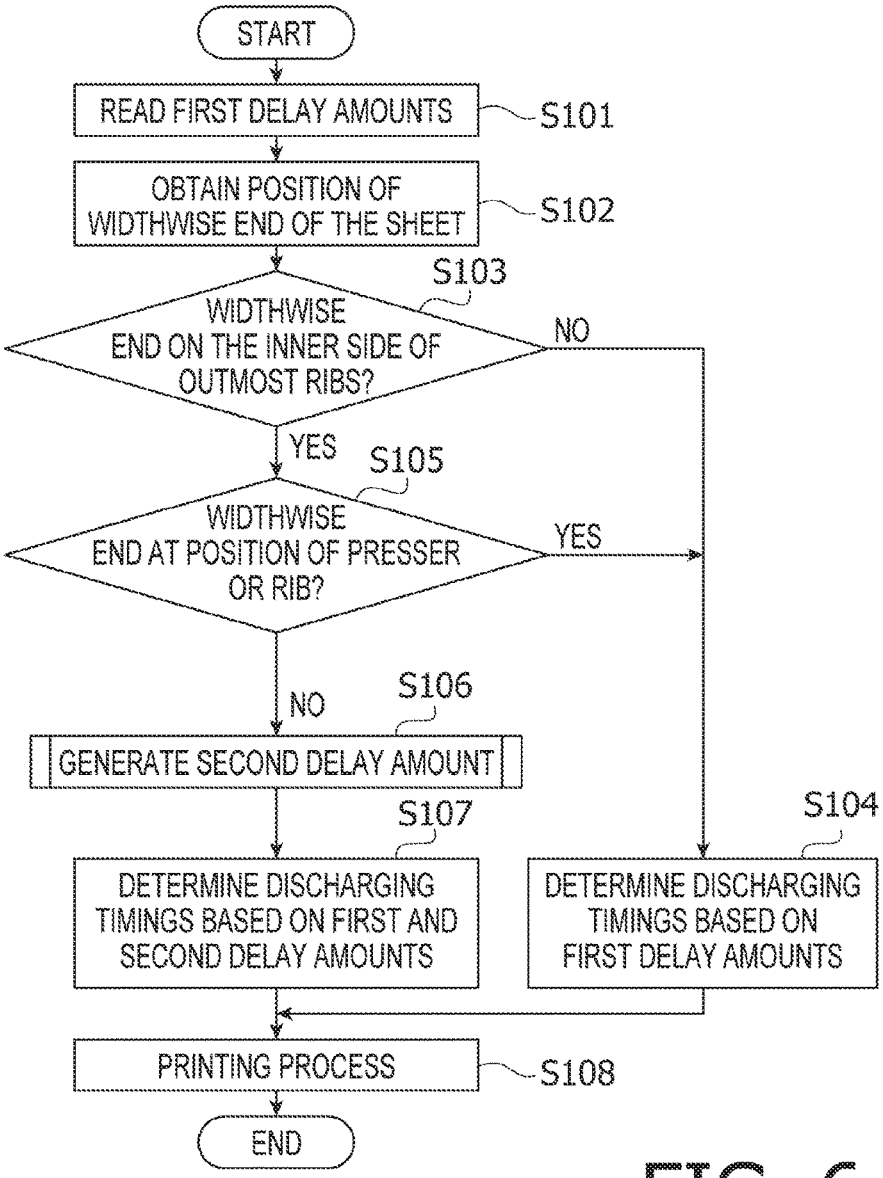
FIG. 6 is a flowchart to illustrate a flow of steps in a printing operation to be conducted by a controller in a printing operation in the inkjet printer according to the embodiment of the present disclosure.

Next, a flow of steps in a printing operation to print an image on the recording sheet P will be described. In the printing operation, the controller 50 may control the printer unit 2 to print an image on the recording sheet P according to the flow of steps shown in FIG. 6.

In order to print an image on the recording sheet P by the printer unit 2, in S101, the controller 50 reads first delay amounts $D_1$-$D_{17}$, which are prepared in advance for positions $F_1$-$F_{17}$ of the pressers 14*a* and the ribs 20 in the scanning direction, from the EEPROM 54. The first delay amounts $D_1$-$D_{17}$ are information related to gaps G (see FIGS. 8A-8B, for example) between the recording sheet P and the ink discharging surface 12*a* of the inkjet head 12 at positions $F_1$-$F_{17}$ of the pressers 14*a* and the ribs 20.

The first delay amounts $D_1$-$D_{17}$ for the positions $F_1$-$F_{17}$ will be described below. As mentioned above, the recording sheet P in the inkjet printer 1 is deformed into the corrugated shape that ripples up and down along the scanning direction. Therefore, an amount of a gap G between the recording sheet P and the ink discharging surface 12*a* may vary depending on a position thereof in the scanning direction. In this regard, if the discharging timings to discharge the ink through the nozzles 10 are set based on an assumption that the gap G is constant regardless of the positions in the scanning direction, the ink droplets discharged from the nozzles 10 may land on the corrugated recording sheet P at unevenly-spaced distances from one another to fluctuate or deviate depending on the positions in the scanning direction. In other words, a quality of the printed image may be lowered.

In consideration of this phenomenon, in order to manipulate the ink to be discharged from the nozzles 10 to land on less deviated positions at more evenly-spaced distance along the scanning direction, the discharging timings to discharge the ink droplets may be adjusted. Specifically, the first delay amounts $D_1$-$D_{17}$ to discharge the ink through the nozzles 10 at the positions $F_1$-$F_{17}$, which are the positions of the ribs 20 and the corrugating plates 14 in the scanning direction, are prepared and stored in the EEPROM 54 in advance (see FIG. 7A). The first delay amounts $D_1$-$D_{17}$ each indicates a length of time to be delayed from a reference discharging timing to discharge the ink through the nozzles at each of the positions $F_1$-$F_{17}$. The reference discharging timing is a timing, at which the ink should be discharged from the nozzles 10, so that the ink droplets should land on the recording sheet P at an evenly-spaced distance along the scanning direction, hypothetically assuming that the recording sheet P is not corrugated and the gap G is constant throughout the entire range along the scanning direction. Meanwhile, on the actual recording sheet P in the corrugated shape, the larger the gap G between the recording sheet P and the ink discharging surface 12*a* is, the longer a duration between discharge of the ink from the nozzles 10 and landing on the ink on the recording sheet P is. Therefore, the first delay amounts $D_1$-$D_{17}$ are designed to be greater at positions, where the gap G between the recording sheet P and the ink discharging surface 12*a* is smaller, and smaller at positions where the gap G is larger.

In the present embodiment, a distance between two (2) of the pressers 14*a* that are arranged on the outmost positions (e.g., the leftward end and rightward end) in the scanning direction is practically the same as a dimension of an A4-sized (210 mm*297 mm) recording sheet P that is deformed into the corrugated shape between the pressers 14*a* and the ribs 20 along the scanning direction. Meanwhile, in order to prepare the first delay amounts $D_1$-$D_{17}$ in advance, a predetermined test pattern may be printed on the recording sheet P in the A4 size while the recording sheet P is conveyed in the printer unit 2 with widthwise ends thereof (e.g., a leftward end $P_L$ and a rightward end $P_R$) being located at the same positions as the positions of the outmost pressers 14*a* with regard to the scanning direction. The printed test pattern may be read by the reader unit 5, and based on the read result, the first delay amounts $D_1$-$D_{17}$ may be determined and stored in the EEPROM 54. The position of the A4-sized recording sheet P in the scanning direction while the test pattern is being printed thereon may be called as a reference position.

Following S101, in S102, the controller 50 obtains a position of a widthwise end $P_L$, $P_R$ in the scanning direction of the recording sheet P. In the following context, the position of the widthwise end $P_L$, $P_R$ in the scanning direction of the recording sheet P may include a position of the leftward end $P_L$ and a position of the rightward end $P_R$ of the recording sheet P. Meanwhile, data of the image to be printed and information concerning the size of the recording sheet P may be received from an external device (not shown), such as a PC, which is connected with the inkjet printer 1. In the present embodiment, the EEPROM 54 stores a table (see FIG. 7B), in which the position of the widthwise end $P_L$, $P_R$ of the recording sheet P in the scanning direction during the printing operation are associated with a plurality of sizes of the recording sheet P. Therefore, in S102, the controller 50 may obtain the position of the widthwise end $P_L$, $P_R$ of the recording sheet P in the scanning direction with reference to the table and based on the received size of the recording sheet P.

Thereafter, in S103, the controller 50 determines whether the position of the widthwise end $P_L$, $P_R$ of the recording sheet P obtained in S102 is on an inner side, with respect to the positions of the outmost pressers 14*a*, closer to a widthwise center in the scanning direction. Specifically, the controller 50 may determine whether the position of the leftward end $P_L$ of the recording sheet P is an inner (rightward) position with respect to the position $F_1$ of the outmost presser 14*a* on the left and whether the position of the rightward end $P_R$ of the recording sheet P is in an inner (leftward) position with respect to the position F17 of the outmost presser 14*a* on the right.

For example, when the size of the recording sheet P is either A4 or A3 (279 mm*420 mm), as shown in FIG. 8A, a position $E_{L1}$ of the leftward end $P_L$ of the recording sheet P is at the same position as the position $F_1$ of the outmost presser 14*a* on the left, and a position $E_{R1}$ of the rightward end $P_R$ of the recording sheet P is at the same position as the position $F_{17}$ of the outmost presser 14*a* on the right. In this regard, when deformed into the corrugated shape, the recording sheets P of the A4 and A3 sizes have a length (width) L1, which is 16 times larger than the interval U/2, along the scanning direction.

For another example, when the size of the recording sheet P is any one of executive (7 in.*10 in.), B5 (182 mm*257 mm), and letter (8.5 in.*11 in.), as shown in FIGS. 8B, 9A, and 9B, respectively, positions $E_{L2}$, $E_{L3}$, $E_{L4}$ of the leftward end $P_{L1}$ of the recording sheet P is at an inner (rightward) position with respect to the position $F_1$ of the outmost presser 14*a* on the left, and the positions $E_{R2}$, $E_{R3}$, $E_{R4}$ of the rightward end $P_R$ is at an inner (leftward) position with respect to the position $F_{17}$ of the outmost presser 14*a* on the right. In this regard, when deformed into the corrugated shape, the recording sheets P of the executive, B5, and letter sizes have lengths (widths) L2, L3, L4, which are smaller than the multiplication of the interval U/2 and 16.

In S103, when the controller 50 determines that the position of the widthwise end $P_L$, $P_R$ of the recording sheet P is not on the inner side with respect to the outmost pressers 14*a* (S103: NO), in S104, the controller 50 determines a discharging timing to discharge the ink through the nozzles 10 based on the first delay amounts $D_1$-$D_{17}$ obtained in S101. For example, the controller 50 may calculate a function that indicates the delay amount at each position in a range between two (2) adjoining positions (e.g., positions $F_1$ and $F_2$, positions $F_2$ and $F_3$, etc.) among the positions $F_1$-$F_{17}$ of the pressers 14*a* and the ribs 20 based on the first delay amounts $D_1$-$D_{17}$. The function may be, for example, a cubic function regarding a position in the scanning direction. Thus, the discharging timing at each position in the scanning direction may be determined based on the delay amount obtained through the function.

Meanwhile, when the position of the widthwise end $P_L$, $P_R$ of the recording sheet P is on the inner side with respect to the outmost ribs 20 in the scanning direction (S103: YES) and at the same position as any of the positions $F_2$-$F_{16}$ of the pressers 14*a* and the ribs 20 (S105: YES), in S104, the controller 50 determines the discharging timing to discharge the ink through the nozzles 10 based on the first delay amounts $D_1$-$D_{17}$ obtained in S101. For example, when the recording sheet P is in the executive size, as shown in FIG. 8B, the position $E_{L2}$ of the leftward end $P_L$ of the recording sheet P may be at the same position as the position $F_3$ of the presser 14*a*, which is the second presser 14*a* from the left; and the position $E_{R2}$ of the rightward end $P_R$ of the recording sheet P may be at the same position as the position $F_{15}$ of the presser 14*a*, which is the second presser 14*a* from the right. In this regard, when deformed into the corrugated shape, the recording sheet P in the executive size has the length L2, which is 12 times larger than the interval U/2, along the scanning direction.

In the meantime, when the position of the widthwise end $P_L$, $P_R$ of the recording sheet P is on the inner side with respect to the outmost ribs 20 in the scanning direction (S103: YES) but at a different position from any of the positions $F_1$-$F_{17}$ of the pressers 14*a* and the ribs 20 (S105: NO), in S106, the controller 50 generates a second delay amount.

A flow of generating the second delay amount will be described with reference to FIG. 10. In S201, the controller 50 determines whether the position of the widthwise end $P_L$, $P_R$ of the recording sheet P falls in an intermediate position between a position $F_n$ (n=2, 4, . . . 16) of one of the ribs 20 and a position $F_m$ (m=n−1 for the leftward end $P_L$, and m=n+1 for the rightward end $P_R$) of one of the pressers 14*a* that is located at an outward and adjoining position in the scanning direction with respect to the one of the ribs 20.

If the widthwise end $P_L$, $P_R$ of the recording sheet P is in the intermediate position between the position $F_n$ of the one of the ribs 20 and the position $F_m$ of the outward adjoining presser 14*a* (S201: YES), in S202, the controller 50 obtains a delay amount $K \cdot D_n$, which is obtained by multiplying the first delay amount $D_n$ for the position $F_n$ by a predetermined coefficient K (K>1, e.g., K=1.1), and stores the obtained delay amount $K \cdot D_n$ in the RAM 53 as the second delay amount. The coefficient K, which is the data to be used to generate the delay amount $K \cdot D_n$, may be prepared and stored in advance in the EEPROM 54.

For example, when the recording sheet P is in the B5 size, the length L3 of the recording sheet P in the corrugated shape along the scanning direction may not be equal to a multiplication product of the interval U and a natural number. Specifically, as shown in FIG. 9A, the leftward end $P_L$ of the recording sheet P may be at a position $E_{L3}$, which is between a position $F_4$ of the second rib 20 from the left and a position $F_3$ of the presser 14*a* that adjoins leftward the second rib 20 from the left. The rightward end $P_R$ of the recording sheet P may be at a position $E_{R3}$, which is between a position $F_{14}$ of the second rib 20 from the right and a position $F_{15}$ that adjoins rightward the second rib 20 from the right. With the recording sheet P in this location, in S202, the delay amount $K \cdot D_4$, which is obtained by the multiplication of the first delay amount $D_4$ for the position $F_4$ and the coefficient K, may be stored in the RAM 53 as the second delay amount for the position $F_3$. Further, the delay amount $K \cdot D_{14}$, which is obtained by the multiplication of the first delay amount $D_{14}$ for the position $F_{14}$ and the coefficient K, may be stored in the RAM 53 as the second delay amount for the position $F_{15}$.

Meanwhile, when the position of the widthwise end $P_L$, $P_R$ of the recording sheet P is in an intermediate position between a position $F_n$ (n=3, 5 . . . 15) of one of the pressers 14*a* and a position $F_m$ (m=n−1 for the leftward end $P_L$, and m=n+1 for the rightward end $P_R$) of one of the ribs 20, which is located at an outward and adjoining position with respect to the one of the pressers 14*a* (S201: NO), in S203, the first delay amount $D_n$ for the position $F_n$ is designated and stored in the RAM 53 as the second delay amount for the position $F_m$.

For example, when the recording sheet P is in the letter size, the length L4 of the recording sheet P in the corrugated shape along the scanning direction may not fall in a multiplication product of the interval U and a natural number. Specifically, as shown in FIG. 9B, the leftward end $P_L$ of the recording sheet P may be at a position $E_{L4}$, which is between a position $F_3$ of the second presser 14*a* from the left and a position $F_2$ of the rib 20 that adjoins leftward the second presser 14*a* from the left. The rightward end $P_R$ of the recording sheet P may be at a position $E_{R4}$, which is between a position $F_{15}$ of the second presser 14*a* from the right and a position $F_{16}$ that adjoins rightward the second presser 14*a* from the right. With the recording sheet P in this location, in S202, the first delay amount $D_3$ for the position $F_3$ is stored in the RAM 53 as the second delay amount for the position $F_2$. Further, the first delay amount $D_{15}$ for the position $F_{15}$ may be stored in the RAM 53 as the second delay amount for the position $F_{16}$.

Returning to FIG. 6, after generating the second delay amount in S106, in S107, the controller 50 determines the discharging timings to discharge the ink through the nozzles 10 based on, for the inner positions than the widthwise end $P_L$, $P_R$ of the recording sheet P in the scanning direction, the first delay amounts $F_1$-$F_{17}$ obtained in S101, and on the second delay amount generated in S106. Specifically, the controller 50 may calculate the function that indicates the delay amount at each position in the range between two (2) adjoining positions among the positions $F_1$-$F_{17}$ of the pressers 14*a* and the ribs 20. Thus, the discharging timing at each position in the scanning direction may be determined based on the delay amount obtained by the function.

After determining the discharging timings in S104 or S107, in S108, the controller 50 conducts a printing process, in which the controller 50 manipulates the carriage 11 to move in the scanning direction and the inkjet head 12 to discharge the ink through the nozzles, to print an image on the recording sheet P.

According to the present embodiment, the recording sheet P is set to be corrugated along the scanning direction by the contact of the ribs 20 and the pressers 14*a*. Meanwhile, the first delay amounts $D_1$-$D_{17}$ for the positions $F_1$-$F_{17}$, which are the values to control the ink droplets to land on intended positions on the recording sheet P without deviation, are prepared and stored in the EEPROM 54. However, the first delay amounts $D_1$-$D_{17}$ are the values to control the ink droplets to land on intended positions on the recording sheet P without deviation when the widthwise ends $P_L$, $P_R$ of the recording sheet P fall on the same positions as the positions $F_1$, $F_{17}$ of the outmost pressers 14*a*, that is, for example, when the recording sheet P is in the A4 size. In other words, the widthwise ends $P_L$, $P_R$ of the recording sheet P may not fall on the same positions as the positions $F_1$, $F_{17}$ of the outmost pressers 14*a* when the recording sheet P is not in the A4 size.

Thus, the position of the widthwise end $P_L$, $P_R$ of the recording sheet P in the scanning direction during the printing operation may vary depending on the size of the recording sheet P. For example, when the recording sheet P is in the B5 or letter size, the widthwise end $P_L$, $P_R$ of the recording sheet P in the scanning direction may fall in the intermediate position between one of the ribs 20 and one of the pressers 14*a*. Thus, the position of the widthwise end $P_L$, $P_R$ of the recording sheet P in the scanning direction may not coincide with the positions $F_1$, $F_{17}$ of the outmost pressers 14*a*.

Therefore, in the present embodiment, when the position of the widthwise end $P_L$, $P_R$ of the recording sheet P falls on any of the positions $F_1$-$F_{17}$, the controller 50 determines the discharging timing to discharge the ink through the nozzles 10 for each position based on the first delay amounts $D_1$-$D_{17}$ stored in the EEPROM 54. Meanwhile, when the position of the widthwise end $P_L$, $P_R$ of the recording sheet P does not fall on any of the positions $F_1$-$F_{17}$ but falls on the inner side between one of the ribs 20 and one of the pressers 14*a*, the second delay amount for the position $F_m$, which is in an outward position with respect to the widthwise end $P_L$, $P_R$ of the recording sheet P along the scanning direction. The controller 50 determines the discharging timing to discharge the ink through the nozzles 10 at each position based on the generated second delay amounts and the first delay amounts for the positions that are on the inner side with respect to the widthwise end $P_L$, $P_R$ of the recording sheet P.

With the discharging timing to discharge the ink through the nozzles 10 for each position in the scanning direction determined as above, the ink may be discharged through the nozzles 10 at the preferable timings.

When, for example, the widthwise end $P_L$, $P_R$ of the recording sheet P is at a position between a position $F_n$ (n=2, 4 . . . , 16) of one of the ribs 20 and a position $F_m$ of the presser 14*a* that adjoins outward the one of the ribs 20, an amount of the gap G between the recording sheet P and the ink discharging surface 12*a* at the outer position from the position $F_n$ may depend largely on an amount of the gap G between the recording sheet P and the ink discharging surface 12*a* at the position $F_n$ of the one of the ribs 20.

Therefore, the amount of the gap G at the position $F_m$ may be estimated approximately from the amount of the gap G at the position $F_n$.

In this regard, the first delay amount $D_m$ for the position $F_m$ is a delay amount for the recording sheet P that forms a bottom Pb at the position $F_m$. In other words, the first delay amount $D_m$ for the position $F_m$ is a delay amount for the recording sheet P where the amount of the gap G may be the largest. In contrast, when the leftward or rightward end $P_L$, $P_R$ of the recording sheet P is in the intermediate position between the position $F_n$ of the one of the ribs 20 and the position $F_m$ of the presser 14*a* that adjoins outward the rib 20, the amount of the gap G at the outer position from the position $F_n$ may be smaller than the amount of the gap G at the position $F_n$.

Based on these conditions, when the widthwise end $P_L$, $P_R$ of the recording sheet P is at an intermediate position between the position $F_n$ of the one of the ribs 20 and the position $F_m$ of the outward adjoining presser 14*a*, the second delay amount for the position $F_m$ may be obtained by the multiplication of the first delay amount $D_n$ for the position $F_n$ and the coefficient K. Accordingly, the second delay amount for the position $F_m$ being larger than the first delay amount $D_m$ for the position $F_m$ is obtained. In this regard, the larger delay amount indicates the smaller amount of the gap G. Based on the second delay amount generated as above and the first delay amounts for the inner positions with respect to the widthwise end $P_L$, $P_R$ of the recording sheet P, the discharging timings to discharge the ink through the nozzles 10 are determined. Thereby, when the widthwise end $P_L$, $P_R$ of the recording sheet P is in the intermediate position between the position $F_n$ of the one of the ribs 20 and the position $F_m$ of the outward adjoining presser 14*a*, the discharging timings may be preferably determined.

According to the present embodiment, in order to generate the second delay amount, it may be necessary that the first delay amounts $D_1$-$D_{17}$ for the positions $F_1$-$F_{17}$ and the coefficient K are stored in the EEPROM 54, but it is not necessary to store the first delay amount $D_1$-$D_{17}$ for every size of the recording sheet P that is usable in the printer 1 in the EEPROM 54. Therefore, a volume of the data to be stored in the EEPROM 54 may be downsized compared to the configuration, which requires data of the first delay amounts $D_1$-$D_{17}$ for every size of the recording sheet P in the EEPROM 54.

According to the present embodiment, when the widthwise end $P_L$, $P_R$ of the recording sheet P falls in the position between the position Fn (n=3, 5, 7, . . . 15) of the one of the pressers 14*a* and the position Fm of the rib 20 that outward adjoins the one of the pressers 14*a*, the amount of the gap G between the recording sheet P and the ink discharging surface 12*a* at an outer position with respect to the position $F_m$ may be determined largely depending on the amount of the gap G between the recording sheet P and the ink discharging surface 12*a* at the position $F_n$. Therefore, the amount of the gap G at the position $F_m$ may be estimated approximately based on the amount of the gap G at the position $F_n$.

According to the present embodiment, the first delay amount $D_m$ for the position $F_m$ is the delay amount for the recording sheet P that forms a peak at the position $F_m$. Meanwhile, when the widthwise end $P_L$, $P_R$ of the recording sheet P is at a position between the position $F_n$ of one of the pressers 14*a* and the position $F_m$ of the rib 20 that outward adjoins the one of the pressers 14*a*, the amount of the gap G between the recording sheet P and the ink discharging surface 12*a* at an outer position with respect to the position $F_n$ may be substantively the same as the amount of the gap G at the position $F_n$.

Based on these conditions, when the widthwise end $P_L$, $P_R$ of the recording sheet P is at the intermediate position between the position $F_n$ of one of the pressers 14*a* and the position $F_m$ of the outward adjoining rib 20, the second delay amount for the position $F_m$ is derived from the first delay amount $D_n$ for the position $F_n$. Accordingly, the second delay amount for the position $F_m$ being smaller than the first delay amount $D_m$ for the position $F_m$ is obtained. In this regard, the smaller delay amount indicates the larger amount of the gap G. Based on the second delay amount generated as above and the first delay amount for the inner positions with respect to the widthwise end $P_L$, $P_R$ of the recording sheet P, the discharging timings to discharge the ink through the nozzles 10 are determined. Thereby, when the widthwise end $P_L$, $P_R$ of the recording sheet P is at the intermediate position between the position $F_n$ of the one of the pressers 14*a* and the position $F_m$ of the outward adjoining rib 20, the discharging timings may be preferably determined.

In the present embodiment, the first delay amounts $D_1$-$D_{17}$ for the recording sheet P in the A4 size are stored in the EEPROM 54. In this regard, the A4 size may be a size, of which dimension along the scanning direction may be the largest among the variety of sizes of the recording sheets P that may be usable in the printer 1, or that may be conveyable by the rollers 13, 16. Therefore, as long as the recording sheet P in the size that is usable in the printer 1 is conveyed, the second delay amount may be generated when needed.

In the present embodiment, the table, in which the positions of the widthwise end $P_L$, $P_R$ of the recording sheet P in the scanning direction are associated with the sizes of the recording sheet P, is stored in the EEPROM 54. Thus, with reference to the size of the recording sheet P, which may be input during the printing operation, and to the table, the position of the widthwise end $P_L$, $P_R$ of the recording sheet P in the scanning direction may be obtained.

Although an example of carrying out the invention has been described, those skilled in the art will appreciate that there are numerous variations and permutations of the liquid discharging device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the position of the widthwise end $P_L$, $P_R$ of the recording sheet P in the scanning direction may not necessarily be obtained from the table stored in the EEPROM 54 based on the size of the recording sheet P that may be input during the printing operation. The position of the widthwise end $P_L$, $P_R$ of the recording sheet P in the scanning direction may be obtained, for example, by moving the medium sensor 19, which faces the recording sheet P, in the scanning direction. If the printer 1 is configured such that t the position of the widthwise end $P_L$, $P_R$ of the recording sheet P in the scanning direction is obtained from the table stored in the EEPROM 54 based on the size of the recording sheet P that may be input during the printing operation, when a recording sheet P in a less common size is used, and if the less common size of the recording sheet P is not stored in the table, the position of the widthwise end $P_L$, $P_R$ of the recording sheet P may not be obtained. In contrast, if the medium sensor 19 is configured to detect the position of the widthwise end $P_L$, $P_R$ of the recording sheet P, the position of the widthwise end $P_L$, $P_R$ of the recording sheet P may be obtained by the medium sensor 19.

For another example, the first delay amounts $D_1$-$D_{17}$ may not necessarily be the delay amounts for the A4 or A3-sized recording sheet P, of which dimension in the scanning direction is the largest among the various sizes of recording sheets P that are usable in the printer 1. The first delay amounts $D_1$-$D_{17}$ may be designed for a recording sheet P, of which dimension in the scanning direction is smaller than the recording sheet P with the largest dimension in the scanning direction among the various sizes of recording sheets P that are usable in the printer 1. Even with the first delay amounts $D_1$-$D_{17}$ designed for the recording sheet P with the smaller dimension in the scanning direction, when printing an image on a recording sheet P, of which dimension in the scanning direction is smaller than the designed recording sheet P, the second delay amount may be generated in the manner described in the above embodiment.

For another example, when the position of the widthwise end $P_L$, $P_R$ of the recording sheet P falls in the intermediate position between the position $F_n$ of one of the ribs 20 and the position $F_m$ of the outward adjoining presser 14*a*, the second delay amount for the position $F_m$ may not necessarily be generated by multiplying the first delay amount $D_n$ for the position $F_n$ by the predetermined coefficient K ($K \cdot D_n$). For example, the second delay amount for the position $F_m$ may be derived from a delay amount, which may be an average value of the first delay amounts for positions of two (2) or more pressers 14*a*, including the position $F_n$, multiplied by the coefficient K.

For another example, when the position of the widthwise end $P_L$, $P_R$ of the recording sheet P falls in the intermediate position between the position $F_n$ of one of the pressers 14*a* and the position $F_m$ of the outward adjoining rib 20, the first delay amount $D_n$ for the position $F_n$ may not necessarily be generated as the second delay amount for the position $F_m$. For example, an average value of the first delay amounts for positions of two (2) or more ribs 20, including the position $F_n$, may be generated to be used as the second delay amount for the position $F_m$.

For another example, the generative data, which is the data to be used to derive the second delay amount from the first delay amounts $D_1$-$D_{17}$, may not necessarily be limited to the coefficient K. For example, the second delay amount may be generated through a different type of generative data such as a function to derive the second delay amount from the first delay amount. As long as a volume of the data for generating the second delay amount is smaller than a volume of the data of the first delay amounts $D_1$-$D_{17}$ for the positions $F_1$-$F_{17}$, a volume of the EEPROM 54 required to store the data for generating the second delay amount is smaller than a volume of the EEPROM 54 required to store the first delay amounts $D_1$-$D_{17}$ for the positions F1-F17 for each of the sizes of the recording sheet P that are usable in the printer 1.

Meanwhile, the volume of the data for generating the second delay amount may not necessarily be smaller but may be larger than the volume of the data of the first delay amounts $D_1$-$D_{17}$ for the positions $F_1$-$F_{17}$.

For another example, the second delay amount may not necessarily be derived from the first delay amount with use of the generative data. For example, the second delay amount for each position, when the position of the widthwise end $P_L$, $P_R$ of the recording sheet P falls in the intermediate position between the position of one of the ribs 20 and the position of the outward adjoining presser 14*a* and when the position of the widthwise end $P_L$, $P_R$ of the recording sheet P falls in the intermediate position between the position of one of the pressers 14*a* and the position of the outward adjoining rib 20, may be stored in the EEPROM 54 so that the second delay amount for the recording sheet P in one of the sizes may be selectively used to determine the discharging timing.

For another example, the second delay amount may not necessarily be directed to the position of one of the ribs 20 or the pressers 14*a* but may be generated for a position, which is different from the positions of the ribs 20 and the pressers 14*a*, on the outer side from the widthwise end $P_L$, $P_R$ of the recording sheet P in the scanning direction. This position may be, for example, a hypothetical position where an amount of the gap G between the recording sheet P and the ink discharging surface 12 is largest or smallest when no rib 20 or presser 14*a* is provided on the outer side of the widthwise end $P_L$, $P_R$ of the recording sheet P in the scanning direction and the recording sheet P is assumed to extend outward beyond the position of the leftward or rightward end $P_L$, $P_R$ to the hypothetical position.

For another example, the EEPROM 54 may not necessarily store all the first delay amounts $D_1$-$D_{17}$ for each of the positions of the pressers 14*a* and the ribs 20. Some of the first delay amounts may be prepared for positions different from the positions of the pressers 14*a* or the ribs 20 in the scanning direction and stored in the EEPROM 54. In other words, the first delay amounts to be stored in the EEPROM 54 may be prepared for positions, which are different from the positions $F_n$ or $F_m$ described in the above embodiment, spaced apart from each other along the scanning direction.

For another example, the EEPROM 54 may not necessarily store the first delay amounts $D_1$-$D_{17}$ for the positions along the scanning direction but may store, for example, information concerning the gaps G between the recording sheet P and the ink discharging surface 12*a* at the plurality of positions along the scanning direction. For example, the information of each amount of the gaps G between the recording sheet P and the ink discharging surface 12*a* at the positions $F_n$, $F_m$ may be stored.

For another example, the printer 1 may not necessarily be configured to print images on the recording sheets P in different sizes but may be configured to print images on the recording sheet solely in a single size. For example, even when the size of the recording sheet P is constant, the recording sheet P may be conveyed in the printer 1 in a skewed orientation with respect to the scanning direction, and the widthwise end $P_L$, $P_R$ of the recording sheet P may fall in the intermediate position between one of the ribs 20 and the adjoining presser 14*a*. Even in such an event, the second delay amount may be generated, and the discharging timing may be preferably determined based on the second delay amount and the first delay amount for the inner position with respect to the widthwise end $P_L$, $P_R$ of the recording sheet P. In this event, it may be necessary that the position of the widthwise end $P_L$, $P_R$ of the recording sheet P in the scanning direction may be achieved from the outputs of the medium sensor 19.

For another example, while the printer 1 may be configured to print images on the recording sheets P in different sizes, the recording sheet P may be conveyed in the printer in a skewed orientation with respect to the scanning direction. In such an event, similarly to the example described above, the second delay amount may be generated, and the discharging timings may be preferably determined based on the second delay amount and the first delay amount for the inner position with respect to the widthwise end $P_L$, $P_R$ of the recording sheet P. In such an event, even when the dimension of the recording sheet P in the scanning direction falls on the multiplication product of the interval U/2, which is the distance between the presser 14*a* and the rib 20, and a natural number, the second delay amount may be generated so that the discharging timings may be preferably determined based on the second delay amount and the first delay amount for the inner position with respect to the widthwise end $P_L$, $P_R$ of the recording sheet P.

For another example, the recording sheet P may not necessarily be deformed by the ribs 20 and the pressers 14*a* into the corrugated shape that ripples up and down along the scanning direction. For example, as shown in FIGS. 11A-11B, the recording sheet P may be set on a platen 101. The platen 101 may be formed to have a plurality of ribs 102, which are evenly spaced apart from one another along the scanning direction. The recording sheet P may be supported by the contact of the ribs 102 from below. Meanwhile, the EEPROM 54 may store the first delay amounts for the positions of the ribs 102 when positions $E_{L5}$, $E_{R5}$ of the widthwise ends $P_L$, $P_R$ of the recording sheet P should fall on the positions of the outmost ribs 102 and when the recording sheet P placed on the ribs 102 should align with the scanning direction. Thus, when the positions of the widthwise ends $P_L$, $P_R$ of the recording sheet P in the scanning direction fall on the positions of the outmost ribs 20, the discharging timings may be determined based on the first delay amounts.

Meanwhile, when a dimension of the recording sheet P in the scanning direction is smaller than the distance between the outmost ribs 20, positions $E_{L6}$, $E_{R6}$ of the widthwise ends $P_L$, $P_R$ of the recording sheet P may fall on intermediate positions, each of which is between two adjoining ribs 102. For example, as shown in FIG. 11B, the position $E_L$6 of the leftward end $P_L$ of the recording sheet P may fall in a position between a position $F_2$ and a position $F_3$, and the position $E_{R6}$ of the rightward end $P_R$ may fall in a position between a position $F_{15}$ and $F_{16}$. In this case, the recording sheet P may curve downward at the widthwise ends $P_L$, $P_R$, and an amount of the gap G between the recording sheet P and the ink discharging surface 12*a* may be enlarged at the widthwise ends $P_L$, $P_R$ to be larger than the amount of the gap G at the widthwise ends $P_L$, $P_R$ of the recording sheet P in FIG. 11A. Therefore, for example, the second delay amount for a position of one of the ribs 102 that is on the outer side of the widthwise end $P_L$, $P_R$ of the recording sheet P may be generated, and the discharging timings to discharge the ink through the nozzles 10 may be determined based on the generated second delay amount and the first delay amounts for the inner positions with respect to the widthwise end $P_L$, $P_R$ of the recording sheet P.

For another example, the discharging timings may not necessarily be determined uniformly for all of the nozzles 10. The plurality of nozzles 10 may be divided into groups of nozzles 10, and the discharging timings may be determined for the group basis. For example, a discharging timing to discharge the black ink through the rightmost nozzle row 9 and a discharging timings to discharge the other colored (yellow, cyan, magenta) inks through the other nozzle rows 9 on the left may be determined separately. For another example, the discharging timing may be determined for each of the nozzle rows 9. For another example, when the nozzle rows 9 are formed to have a substantial length along the conveying direction, the gap G between the recording sheet P and the ink discharging surface 12*a* may fluctuate along the conveying direction. That is, an amount of the gap G between the nozzles 10 in an upstream area with regard to the conveying direction and an amount of the gap between the nozzles 10 in a downstream area with respect to the conveying direction may not be the same but may be different. Therefore, the nozzles 10 in each nozzle row 9 may be divided into, for example, two (2), along the conveying direction, and a discharging timing for the nozzles 10 in the upstream area and a discharging timing for the nozzles 10 in the downstream area may be separately determined.

For another example, the embodiment described above may not necessarily be applied to the inkjet printer 1 being a serial printer, which is configured to discharge the ink from the inkjet head 21 while the inkjet head 12 on the carriage 11 moves in the scanning direction, but may be applied to an line printer having a linear inkjet head, which extends linearly throughout an entire widthwise range in a widthwise direction intersecting with the conveying direction. The line-typed printer with the liner inkjet head may be equipped with a sensor to detect positions of widthwise ends of the recording sheet P and a sensor carriage, on which the sensor may be mounted. The sensor carriage may be disposed on an upstream side of the linear inkjet head with regard to the conveying direction.

For another example, the embodiment described above may not necessarily be applied to an inkjet printer, in which the ink is discharged through the nozzles to print an image on the recording sheet P, but may be similarly applied to a liquid ejecting device that may eject liquid through nozzles at a sheet.

What is claimed is:

1. A liquid discharging device, comprising:

a liquid discharging head comprising a plurality of nozzles and a liquid discharging surface, the plurality of nozzles being arranged on the liquid discharging surface;

a carriage, on which the liquid discharging head is mounted, the carriage being configured to move in a scanning direction, the scanning direction being parallel with the liquid discharging surface of the liquid discharging head;

a sheet conveyer configured to convey a sheet in a conveying direction, the conveying direction being parallel with the liquid discharging surface and intersecting with the scanning direction;

a plurality of contact parts arranged to be spaced apart from one another along the scanning direction, the plurality of contact parts being configured to contact the sheet along a direction orthogonal to the liquid discharging surface, the sheet being conveyed to face the liquid discharging surface;

a gap information storage configured to store first gap information, the first gap information being related to a gap between the sheet and the liquid discharging surface; and a controller configured to control the liquid discharging head and the carriage, wherein the controller is configured to execute:

an end position obtaining process, in which the controller obtains a position of an end of the sheet in the scanning direction;

a position determining process, in which the controller determines whether the position of the end of the sheet obtained in the end position obtaining process is located on an inner side of an outmost contact part among the plurality of contact parts along the scanning direction;

a gap information generating process, in which the controller generates second gap information under a condition where the position of the end of the sheet obtained in the end position obtaining process is determined to be located on the inner side of the outmost contact part among the plurality of contact parts along the scanning direction, the second gap information being related to a gap between the sheet and the liquid discharging surface at a position on an outer side of one of the plurality of contact parts that contacts the end of the sheet;

a discharging-timing determining process, in which the controller determines discharging timings to discharge the liquid from the plurality of nozzles; and a liquid discharging process, in which the controller manipulates the carriage to move in the scanning direction and the liquid discharging head to discharge the liquid from the plurality of nozzles at the discharging timings determined in the discharging-timing determining process, wherein, under a condition where the position of the end of the sheet obtained in the end position obtaining process is determined not to be located on the inner side of the outmost contact part among the plurality of contact parts along the scanning direction in the position determining process, in the discharging-timing determining process, the controller determines the discharging timings to discharge the liquid from the plurality of nozzles based on the first gap information stored in the gap information storage; and wherein, under the condition where the position of the end of the sheet obtained in the end position obtaining process is determined to be located on the inner side of the outmost contact part among the plurality of contact parts along the scanning direction in the position determining process, in the discharging-timing determining process, the controller determines the discharging timings to discharge the liquid from the plurality of nozzles based on the first gap information stored in the gap information storage and on the second gap information generated in the gap information generating process.

2. The liquid discharging device according to claim 1, wherein the first gap information is related to gaps between the sheet and the liquid discharging surface at a plurality of positions spaced apart from one another along the scanning direction, wherein, in the gap information generating process, the controller generates the second gap information based on inner-side first gap information among the first gap information stored in the gap information storage, the inner-side first gap information being related to one of the gaps between the sheet and the liquid discharging surface at a position on an inner side with respect to the end of the sheet in the scanning direction.

3. The liquid discharging device according to claim 2, further comprising a generative data storage configured to store generative data, the generative data being used to generate the second gap information from the inner-side first gap information, wherein a volume of the generative data to be stored in the generative data storage is smaller than a volume of the first gap information stored in the gap information storage.

4. The liquid discharging device according to claim 1, wherein the plurality of contact parts comprise a plurality of pressing members and a plurality of supporting members, the plurality of pressing members being arranged to be spaced apart from one another along the scanning direction to press the sheet from a side of the liquid discharging head, and the plurality of supporting members being arranged alternately with the plurality of pressing members along the scanning direction to support the sheet from a side opposite from the liquid discharging head.

5. The liquid discharging device according to claim 4, wherein the gap information storage stores the first gap information related to gaps between the sheet and the liquid discharging surface at a plurality of positions along the scanning direction where the plurality of pressing members are arranged and where the plurality of supporting members are arranged;

wherein the controller is configured to determine whether the position of the end of the sheet obtained in the end position obtaining process is at an intermediate position between one of the plurality of supporting members and one of the plurality of pressing members that adjoins outward the one of the plurality of supporting members along the scanning direction; and wherein, under a condition where the position of the end of the sheet obtained in the end position obtaining process is determined to be at the intermediate position, in the gap information generating process, the controller generates the second gap information, related to one of the gaps at a position of the one of the plurality of pressing members, indicating that the one of the gaps at the position of the one of the plurality of pressing members is smaller than a gap at the same position of the one of the plurality of pressing members indicated in the first gap information.

6. The liquid discharging device according to claim 5, wherein, under a condition where the position of the end of the sheet obtained in the end position obtaining process is determined not to be at the intermediate position, in the gap information generating process, the controller designates a value indicated in the first gap information related to the one of the gaps at the position of the one of the plurality of pressing members as the second gap information.

7. The liquid discharging device according to claim 5, wherein the controller is configured to generate the second gap information by multiplying a value for the one of the gaps at the position of the one of the plurality of pressing members indicated in the first gap information by a predetermined coefficient being greater than one.

8. The liquid discharging device according to claim 4, wherein the gap information storage stores the first gap information related to gaps between the sheet and the liquid discharging surface at a plurality of positions along the scanning direction where the plurality of pressing members are arranged and where the plurality of supporting members are arranged;

wherein the controller is configured to determine whether the position of the end of the sheet obtained in the end position obtaining process is at an intermediate position between one of the plurality of pressing members and one of the plurality of supporting members that adjoins outward the one of the plurality of pressing members along the scanning direction; and wherein, under a condition where the position of the end of the sheet obtained in the end position obtaining process is determined to be at the intermediate position, in the gap information generating process, the controller generates the second gap information, related to one of the gaps at a position of the one of the plurality of supporting members, indicating that the one of the gaps at the position of the one of the plurality of supporting members is greater than a gap at the same position of the one of the plurality of supporting members indicated in the first gap information.

9. The liquid discharging device according to claim 8, wherein, under a condition where the position of the end of the sheet obtained in the end position obtaining process is determined not to be at the intermediate position, in the gap information generating process, the controller designates a value indicated in the first gap information related to the one of the gaps at the position of the one of the plurality of pressing members as the second gap information for the gap at the position of the one of the plurality of supporting members.

10. The liquid discharging device according to claim 1, wherein the sheet conveyer is configured to convey a first-typed sheet and a second-typed sheet, of which dimension in the scanning direction is smaller than a dimension of the first-typed sheet in the scanning direction, and wherein the first gap information is related to gaps between the first-typed sheet and the liquid discharging surface at a plurality of positions under a condition where the first-type sheet being conveyed by the sheet conveyer is located at a predetermined reference position in the scanning direction.

11. The liquid discharging device according to claim 10, wherein the plurality of contact parts are arranged to be spaced apart evenly from one another at an interval along the scanning direction, and wherein the dimension of the second-typed sheet in the scanning direction is unequal to a multiplication product of the interval and a natural number.

12. The liquid discharging device according to claim 10, wherein the first-typed sheet is a sheet having a dimension in the scanning direction that is largest among a plurality of types of sheets that are conveyable by the sheet conveyer.

13. The liquid discharging device according to claim 1, further comprising a table storage configured to store a table, in which the position of the end of the sheet in the scanning direction is associated with a size of the sheet, wherein the controller is configured to receive information concerning the size of the sheet prior to executing the end position obtaining process, and wherein, in the end position obtaining process, the controller obtains the position of the end of the sheet with reference to the size of the sheet indicated in the received information and the table stored in the table storage.

14. The liquid discharging device according to claim 1, further comprising a sensor configured to detect the position of the end of the sheet in the scanning direction, wherein, in the end position obtaining process, the controller obtains the position of the end of the sheet based on a detected result from the sensor.

15. The liquid discharging device according to claim 1, wherein the gap between the sheet and the liquid discharging surface includes gaps between the sheet and the liquid discharging surface at a plurality of positions spaced apart from one another along the scanning direction; and wherein the first gap information includes inner-side first gap information, the inner-side first gap information being related to gaps between the sheet and the liquid discharging surface at positions on an inner side with respect to the end of the sheet in the scanning direction.

16. A liquid discharging device, comprising:

a liquid discharging head comprising a plurality of nozzles and a liquid discharging surface, the plurality of nozzles being arranged on the liquid discharging surface;

a sheet conveyer configured to convey a sheet in a conveying direction, the conveying direction being parallel with the liquid discharging surface;

a plurality of contact parts arranged to be spaced apart from one another along a width direction, the width direction being parallel with the liquid discharging surface and intersecting with the conveying direction, the plurality of contact parts being configured to contact the sheet along a direction orthogonal to the liquid discharging surface, the sheet being conveyed to face the liquid discharging surface;

a gap information storage configured to store first gap information, the first gap information being related to gaps between the sheet and the liquid discharging surface at a plurality of positions spaced apart from one another along the width direction; and a controller configured to control the liquid discharging head, wherein the controller is configured to execute:

an end position obtaining process, in which the controller obtains a position of an end of the sheet in the width direction;

a position determining process, in which the controller determines whether the position of the end of the sheet obtained in the end position obtaining process is located on an inner side of an outmost contact part among the plurality of contact parts along the width direction;

a gap information generating process, in which the controller generates second gap information under a condition where the position of the end of the sheet obtained in the end position obtaining process is determined to be located on the inner side of the outmost contact part among the plurality of contact parts along the width direction, the second gap information being related to a gap between the sheet and the liquid discharging surface at a position on an outer side of one of the plurality of contact parts that contacts the end of the sheet;

a discharging-timing determining process, in which the controller determines discharging timings to discharge the liquid from the plurality of nozzles; and a liquid discharging process, in which the controller manipulates the liquid discharging head to discharge the liquid from the plurality of nozzles at the discharging timings determined in the discharging-timing determining process, wherein, under a condition where the position of the end of the sheet obtained in the end position obtaining process is determined not to be located on the inner side of the outmost contact part among the plurality of contact parts along the width direction in the position determining process, in the discharging-timing determining process, the controller determines the discharging timings to discharge the liquid from the plurality of nozzles based on the first gap information stored in the gap information storage; and wherein, under the condition where the position of the end of the sheet obtained in the end position obtaining process is determined to be located on the inner side of the outmost contact part among the plurality of contact parts along the width direction in the position determining process, in the discharging-timing determining process, the controller determines the discharging timings to discharge the liquid from the plurality of nozzles based on inner-side first gap information among the first gap information stored in the gap information storage and on the second gap information generated in the gap information generating process, the inner-side first gap information being related to the gaps between the sheet and the liquid discharging surface at positions on an inner side with respect to the end of the sheet in the width direction.

* * * * *